US007665194B2

(12) United States Patent
Iwase

(10) Patent No.: US 7,665,194 B2
(45) Date of Patent: Feb. 23, 2010

(54) SLIDE FASTENER

(75) Inventor: Yuichi Iwase, Toyama-Ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 12/204,466

(22) Filed: Sep. 4, 2008

(65) Prior Publication Data

US 2009/0064468 A1 Mar. 12, 2009

(30) Foreign Application Priority Data

Sep. 7, 2007 (JP) ..... 2007-233120

(51) Int. Cl.
*A44B 19/30* (2006.01)

(52) U.S. Cl. ..... 24/419

(58) Field of Classification Search ..... 24/419
See application file for complete search history.

(56) References Cited

U.S. PATENT DOCUMENTS 1,833,689 A * 11/1931 Nicholson ..... 24/419
1,969,672 A * 8/1934 Poux ..... 24/419
2,019,220 A * 10/1935 Gammons ..... 24/419
2,162,266 A * 6/1939 Marinsky ..... 24/419
2,450,779 A * 10/1948 Brozek ..... 24/419
2,537,749 A * 1/1951 Gloss ..... 24/419
2,540,693 A * 2/1951 Shur ..... 24/419
2,972,793 A 2/1961 Burbank
3,112,546 A * 12/1963 Jensen ..... 24/419

FOREIGN PATENT DOCUMENTS

JP 2000-333710 12/2000

* cited by examiner

*Primary Examiner*—James R Brittain
(74) *Attorney, Agent, or Firm*—Darby & Darby PC

(57) ABSTRACT

A slide fastener with a slider locking mechanism comprising a slider body, a tab attached to the slider body rotatably, and a slider having a locking pawl formed integrally with the tab, wherein the locking pawl has a pawl portion fitted into between the elements, and the pawl portion comprises: a first contact surface which, when the tab is rotated after sliding operation of the slider is ended, contacts with a first element of an element row attached to a fastener stringer to stop the tab's rotation temporarily; and a second contact surface which, when the slider starts a forced movement in an element separating direction with the tab's rotation stopped, contacts with a second element to stop the slider's forced movement in a state where the tab restarts to rotate and the pawl portion is fitted into between the elements.

12 Claims, 8 Drawing Sheets

SLIDE FASTENER

CROSS REFERENCE TO RELATED APPLICATIONS

The present invention claims priority under 35 U.S.C. §119 to Japanese Patent Application No. 2007-233120, filed on Sep. 7, 2007. The contents of the application is hereby incorporated by reference in its entirety.

BACKGROUND OF THE INVENTION

1. Field of the Invention

The present invention relates to a slide fastener with a slider locking mechanism capable of automatically locking a slider without use of any resilient member.

2. Description of the Related Art

As a conventional slide fastener for use in clothes, there has been known a type in which a slider having a locking mechanism is inserted through an element row in order to prevent right and left fastener stringers from being opened unintentionally when the slider is not operated. Generally, the slider having the locking mechanism has a locking pawl capable of advancing to and retracting from an element guide passage formed between upper and lower blades of the slider and a leaf spring for urging the locking pawl into the element guide passage. When the slider is not operated, the locking pawl is urged by the leaf spring so as to engage a part (pawl portion) of the locking pawl with the element row, thereby stopping movement of the slider.

By the way, as a measure to environmental problems in recent years, it has been demanded to form respective components which constitute a product of the same material in order to facilitate recycling of materials. However, in sliders having the above-described conventional locking mechanism, for example, often the slider and tab are molded of synthetic resin while the leaf spring having resilience is formed of a metallic member. That is, in many cases, the leaf spring is formed of a different material from the other members. For the reason, when recycling the materials of the slider, its components need to be separated, thereby taking time and labor, which is a problem of the prior art.

Although a resilient member such as the leaf spring is sometimes formed of synthetic resin in order to solve the problem about recycle, usually, the resilient member made of synthetic resin is likely to be deteriorated with a time passage so that the resilience is lost with a long term usage, which is another problem.

A slider with a locking mechanism configured of components made of the same material without use of any leaf spring considering the recycle of the slider has been disclosed in Japanese Patent Laid-Open Publication No. 2000-333710. Further, U.S. Pat. No. 2,972,793 has disclosed a slider with a locking mechanism without use of any leaf spring.

In the slider described in Japanese Patent Laid-Open Publication No. 2000-333710, all its components are formed of synthetic resin and more specifically, the slider is constituted of four synthetic resin components, a slider body, a tab, a locking pawl (pawl) and a cover body for attaching the tab to the slider body. The tab has a mounting shaft (pintle) for attaching the tab to the slider body rotatably and a cam having a thumb-shaped section provided projectingly at right angle with respect to the longitudinal direction of the tab from the mounting shaft.

In the slider of Japanese Patent Laid-Open Publication No. 2000-333710 having such a structure, when the tab attached to the slider body is held at a non-operation position by rotating the tab to a rear mouth side, the locking pawl accommodated in the slider body is pressed by the cam. Consequently, the locking pawl presses right and left element rows and at the same time, a part of the locking pawl is fitted into between elements, thereby locking the slider.

U.S. Pat. No. 2,972,793 has described a slider 81 with a locking mechanism in which as shown in FIG. 13, a tab 82 includes a mountain-like locking pawl 83 and a hook-shaped retractable pawl 84 (see FIG. 2 of U.S. Pat. No. 2,972,793). According to U.S. Pat. No. 2,972,793, the retractable pawl 84 is a pawl which first engages an element row 85 when the tab 82 is pushed down, and if the fastener is moved, when the tab 82 is at a non-locked position, the retractable pawl 84 and the locking pawl 83 are retracted into a locked position. That is, in the slider 81 of U.S. Pat. No. 2,972,793-A1, when the retractable pawl 84 is retracted into an element row 85, the tab 82 is rotated so that the locking pawl 83 engages the element row 85 to thereby lock the slider 81.

In the slider made of synthetic resin described in Japanese Patent Laid-Open Publication No. 2000-333710, when the locking pawl presses the element row while a part of the locking pawl fits into between the elements, the slider is locked easily. However, to lock the slider in this way, a user needs to rotate the tab and press the locking pawl with a cam provided on the tab. That is, the slider cannot be automatically locked.

Further, according to Japanese Patent Laid-Open Publication No. 2000-333710, because the cam and locking pawl of the tab receive a large load when the slider is locked, the cam and locking pawl are worn as a result of repeated usage in a long period. Consequently, a locking function of the slider is lowered or becomes inoperative. Additionally, while the slider of Japanese Patent Laid-Open Publication No. 2000-333710 is constituted of four members, the reduction in the number of the components of the slider has been demanded in views of reduction of manufacturing cost and ease of assembly.

In the slider 81 described in U.S. Pat. No. 2,972,793, when the fastener is moved as described above, the retractable pawl 84 is retracted into the element row 85 so that the tab 82 is rotated. Thus, the slider can be locked without user's rotating the tab unlike the slider of Japanese Patent Laid-Open Publication No. 2000-333710.

However, because in the slider 81 of U.S. Pat. No. 2,972,793, two small pawls different in shape, the locking pawl 83 and retractable pawl 84, need to be formed for the tab 82, the configuration of the tab 82 becomes complicated and the size of the slider 81 tends to be enlarged. Further, U.S. Pat. No. 2,972,793 has no description about the positions and the dimensions of the locking pawl 83 and the retractable pawl 84 which are formed in the tab 82. In the slider 81 of U.S. Pat. No. 2,972,793, it is important to set up positions and dimensions of the locking pawl 83 and the retractable pawl 84 appropriately. The locking pawl 83 is worn considerably or the slider 81 cannot be locked stably depending on the positions and dimensions of the locking pawl 83 and the retractable 84.

SUMMARY OF THE INVENTION

The present invention has been achieved in views of the above-described conventional problems and an object of the invention is to provide a slide fastener capable of automatically locking the slider without use of any resilient member and stably maintaining the locking function of the slider even if the slide fastener is used in a long period.

To achieve the above-described object, the present invention provides a slide fastener with a slider locking mechanism having a pair of right and left fastener stringers in which element rows are attached to opposing tape side edge portions of a pair of fastener tapes and a slider, through which the element rows are inserted, the slider comprising a slider body in which element guide passages are formed between an upper blade having at least one window portion and a lower blade; a tab attached rotatably to a top face side of the upper blade; and at least one locking pawl which is formed integrally on the tab and projected into the element guide passage through the window portion in the upper blade to be capable of fitting into between elements constituting the element row, the locking pawl having at least one pawl portion to fit into between the elements, being characterized in that the pawl portion comprises: a first contact surface which, when the tab is rotated after sliding operation of the slider is ended, comes into contact with a first element of the element row so as to stop a rotation of the tab temporarily; and a second contact surface which, when the fastener stringer receives a lateral pulling force in a rotation stopped state where the rotation of the tab is stopped temporarily so that the slider starts a forced movement in an element separating direction, makes contact with a second element adjoining the first element in a rear side direction so as to stop the forced movement of the slider in a state where the tab restarts to rotate due to release of the rotation stopped state and the pawl portion is fitted into between the elements.

Preferably, the first contact surface of the pawl portion stops the rotation of the tab temporarily by coming into contact with the first element of the element row when the tab is rotated by its own weight after sliding operation of the slider, and the tab restarts to rotate by its own weight when the slider starts the forced movement in the element separating direction in the rotation stopped state where the rotation of the tab is stopped temporarily.

Preferably, the first contact surface of the pawl portion stops the rotation of the tab temporarily by coming into contact with the first element of the element row in a state where the tab is tilted to a rear mouth side after sliding operation of the slider, the second contact surface is made contacted with the second element when the slider starts the forced movement in the element separating direction in the rotation stopped state where the rotation of the tab is stopped temporarily, and when the rotation of the tab is stopped at its rotation limit with the second contact surface kept in contact with the second element, the forced movement of the slider is stopped.

Preferably, the locking pawl is so configured that, by the slider being moved forcibly from the rotation stopped state of the tab, the first contact surface of the pawl portion is brought into contact with the first element while the tab restarts a rotation by its own weight and the pawl portion is fitted into between the first and second elements by the rotation of the tab, and by the slider being further moved forcibly in a state where the pawl portion is fitted in between the elements, the second contact surface of the pawl portion is brought into contact with the second element, and when the rotation of the tab is stopped at its rotation limit with the second contact surface kept in contact with the second element, the forced movement of the slider is stopped.

Preferably, the locking pawl is provided to be extended from a rotation shaft portion possessed by the tab.

Preferably, the locking pawl is provided to be extended in a direction perpendicular to an upper blade side with respect to a longitudinal direction of the tab.

Preferably, the locking pawl has a pawl proximal portion connected to the tab and the pawl portions are provided to be respectively extended from right and left front ends of the pawl proximal portion while positions thereof are shifted by a gap between the elements in a longitudinal direction of the tab.

Preferably, an angle θ between a top face on a rear mouth side of the upper blade and the tab, when the locking pawl is retracted completely from the element guide passage, is set to be 30° or more and 50° or less.

Preferably, a ratio B/A where A denotes a length from a center of an axis of a rotation shaft portion of the tab up to a front end of the pawl portion of the locking pawl and B denotes a length from an inner face of the upper blade of the slider up to the front end of the pawl portion of the locking pawl when the forced movement of the slider is stopped, is set to be 0.14 or more and 0.35 or less.

Preferably, the length B is set to be 0.5 mm or more and 1.0 mm or less.

A slide fastener according to the present invention has a pair of right and left fastener stringers and a slider, and the slider includes a slider body in which an element guide passage is formed between an upper and lower blades, a tab attached rotatably to the top face side of the upper blade, and locking pawls which are formed integrally with the tab and can be projected into the element guide passage through window portions formed in the upper blade so as to be fitted into between elements.

The locking pawl has a pawl portion, and the pawl portion includes a first contact surface and a second contact surface. In this case, when the tab is rotated by its own weight after the sliding operation of the slider is ended, the first contact surface of the pawl portion comes into contact with a first element of an element row so as to stop the rotation of the tab temporarily. When the fastener stringer receives a lateral pulling force in the rotation stopped state of the tab so that the slider starts a forced movement in an element separating direction, the first contact surface of the pawl portion comes into contact with the second element, in a state where the tab restarts the rotation by its own weight and the pawl portion is fitted into between the elements, thereby stopping the forced movement of the slider. In the meantime, in the present invention, the forced movement of the slider refers to a different movement from an ordinary movement of sliding the slider by gripping the tab.

In the slide fastener of the present invention having such a slider, the pawl portion of the locking pawl can be fitted into between the elements using the rotation of the tab by its own weight and the forced movement of the slider in the element separating direction. Consequently, the slider can be automatically locked without use of any resilient member such as a leaf spring.

In the slide fastener of the present invention, when locking the slider, the pawl portion of the locking pawl can be fitted into between the elements easily by its own weight without use of any cam for pressing the locking pawl unlike in the slider described in Japanese Patent Laid-Open Publication No. 2000-333710. Consequently, the locking pawl can be prevented from being worn out even if locking of the slider is repeated. Thus, the locking function of the slider can be maintained stably in a long period.

Further, in the slider for use in the slide fastener of the present invention, the locking pawl and the tab are formed integrally. Thus, the present invention enables the number of components of the slider to be smaller than a slider in which the tab and the locking pawl are formed of different components like in Japanese Patent Laid-Open Publication No. 2000-333710. As a result, reduction of cost of the slider can be achieved, so that assembly of the slider is made easier.

Particularly, the locking pawl of the present invention is so configured that, when the slider is moved forcibly from the rotation stopped state of the tab, the first contact surface of the pawl portion is brought into contact with the first element while the tab restarts a rotation by its own weight and the pawl portion is fitted into between the first and second elements by the rotation of the tab, that, when the slider is moved forcibly further in a state where the pawl portion is fitted in between the elements, the second contact surface of the pawl portion is brought into contact with the second element, and that, when the rotation of the tab is stopped at its rotation limit with the second contact surface kept in contact with the second element, the forced movement of the slider is stopped. Consequently, when the slider is moved forcibly, the slider can be stopped and locked further stably.

In the slide fastener of the present invention, the locking pawl is extended in a direction perpendicular to the upper blade side with respect to the longitudinal direction of the tab from the rotation shaft portion of the tab. Consequently, the rotation of the tab is stopped with the second contact surface making contact with the second element, so as to stop the forced movement easily, thereby locking the slider securely. In the meantime, with the constitution that the locking pawl is extended in a direction perpendicular to the upper blade side with respect to the longitudinal direction of the tab, the front face of a pawl proximal portion of the locking pawl is brought into contact with the front wall face of the window portion formed in the upper blade, whereby the rotation of the tab can be stopped securely with the second contact surface making contact with the second element as described above.

In the present invention, the locking pawl has the pawl proximal portion connected to the tab, and the pawl portions are extended each from the right and left front ends of the pawl proximal portion while positions of the right and left pawl portions are shifted by a gap between the elements in the longitudinal direction of the tab. Consequently, the right and left pawl portions of the locking pawls can be fitted into between the elements of the right and left element rows easily so as to lock the slider securely.

Further, according to the present invention, preferably, the angle θ between the top face on the rear mouth side of the upper blade and the tab when the locking pawl is retracted completely from the element guide passage is set to 30° or more and 50° or less, and more preferably, 35° or more and 45° or less. According to a survey by the inventors of the present invention, it has become evident that in a case where the slider fastener is attached to a fly of clothes, a tilting angle of the tab with respect to the upper blade when the slider is slid in the element separating direction by gripping the tab is larger than 50°.

Therefore, the angle θ between the upper blade and the tab when the locking pawl is retracted from the element guide passage, as described above, is set to 50° or less. With this configuration, when the slider is slid in the element separating direction or in the closing direction, the locking pawl can be prevented from being hooked by the element row, thereby smoothly performing the sliding operation of the slider. Further, the angle θ between the upper blade and the tab when the locking pawl is retracted from the element guide passage is set to 30° or more. With this configuration, a projection amount of the locking pawl projecting into the element guide passage, when the tab is tilted completely to the rear mouth side of the upper blade can be secured to an appropriate amount so as to lock the slider stably.

In this case, a ratio B/A where A denotes a length from a center of an axis of the rotation shaft portion of the tab up to a front end of the pawl portion of the locking pawl and B denotes a length from an inner face of the upper blade of the slider up to the front end of the pawl portion of the locking pawl when the forced movement of the slider is stopped, is set to 0.14 or more and 0.35 or less. Consequently, when the angle of the tab with respect to the upper blade is 30° or more and 50° or less, the locking pawl can be retracted completely from the element guide passage.

Further, according to the present invention, the length B is set to 0.5 mm or more and 1.0 mm or less. Consequently, when the slider is moved forcibly from the rotation stopped state of the tab, the pawl portion can be fitted into between the elements smoothly and securely so as to lock the slider further stably.

DESCRIPTION OF THE PREFERRED EMBODIMENTS

Hereinafter, preferred embodiments of the present invention will be described in detail with reference to the accompanying drawings with examples.

First Embodiment

Figure 1:
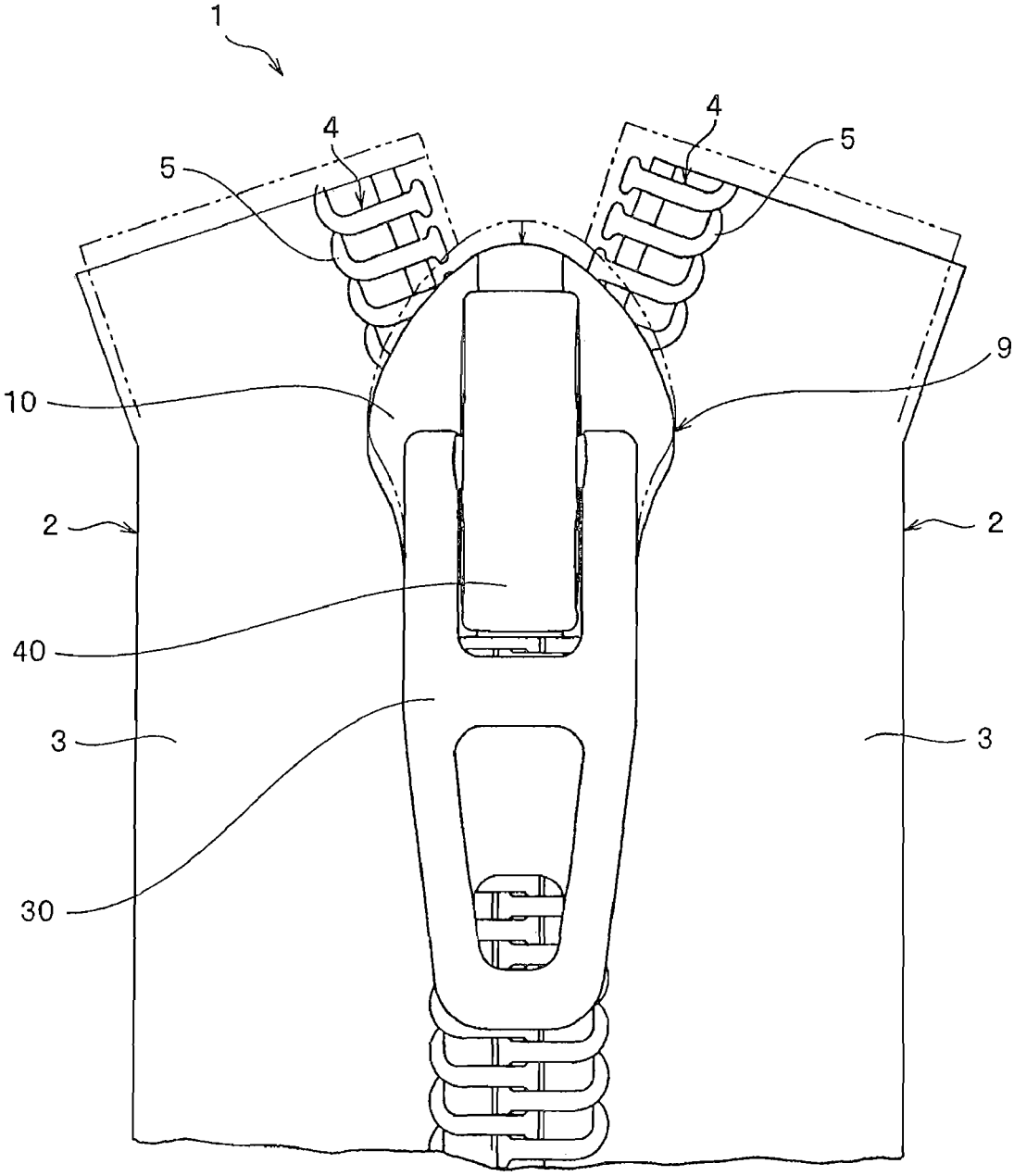
FIG. 1 is a front view of a slide fastener according to a first embodiment of the present invention.
Figure 2:
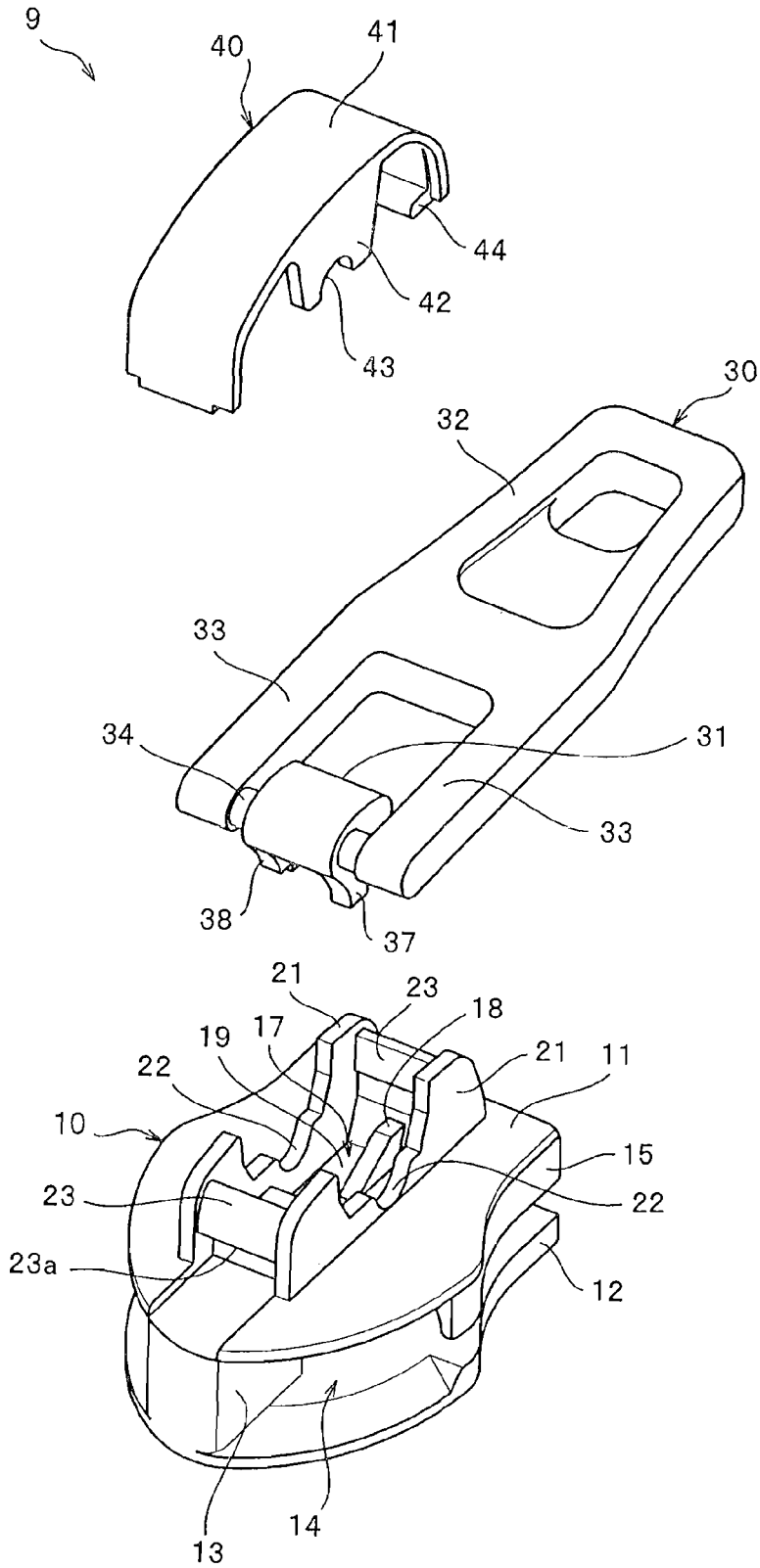
FIG. 2 is an exploded perspective view showing a slider provided on the slide fastener in a disassembled state.
Figure 3:
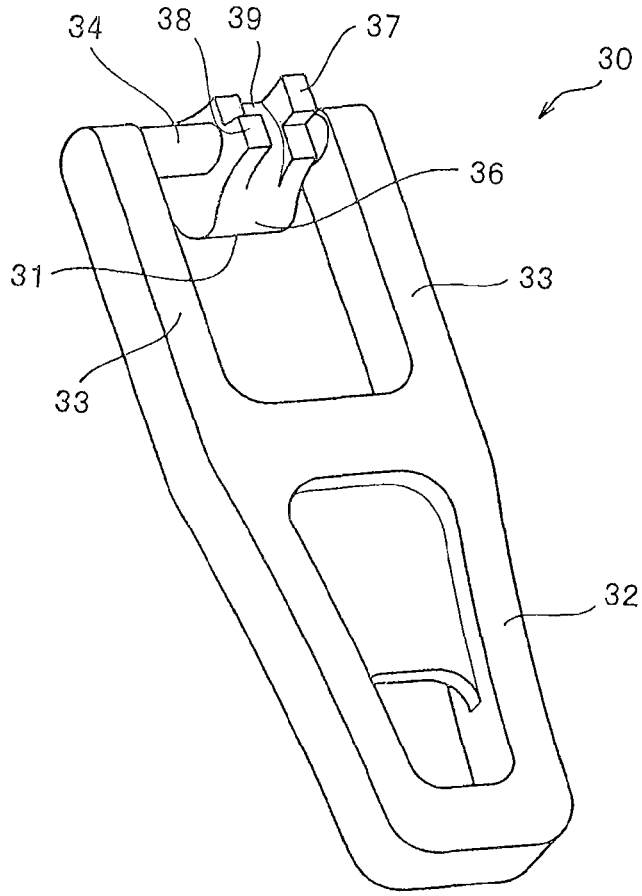
FIG. 3 is an enlarged perspective view showing a tab and locking pawl of the slider in enlargement.
Figure 4:
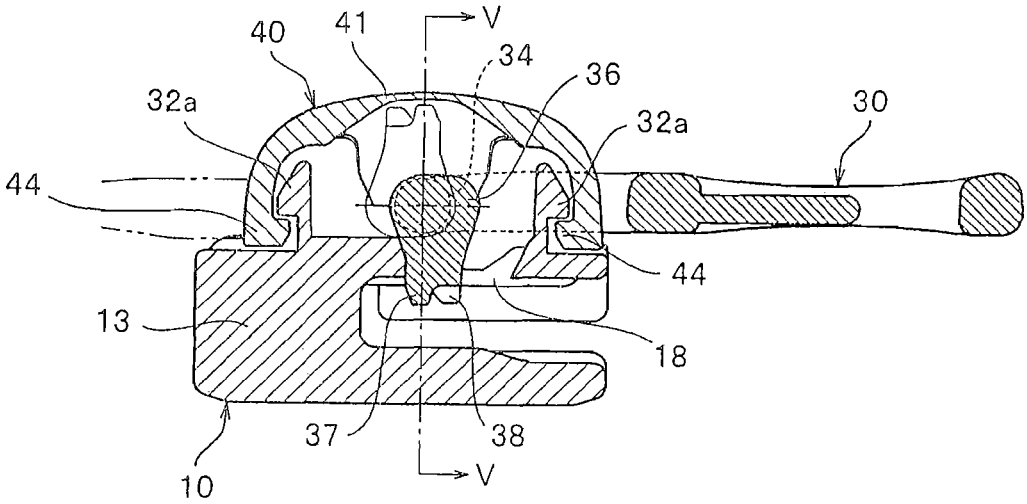
FIG. 4 is a longitudinal sectional view of the slider.
Figure 5:
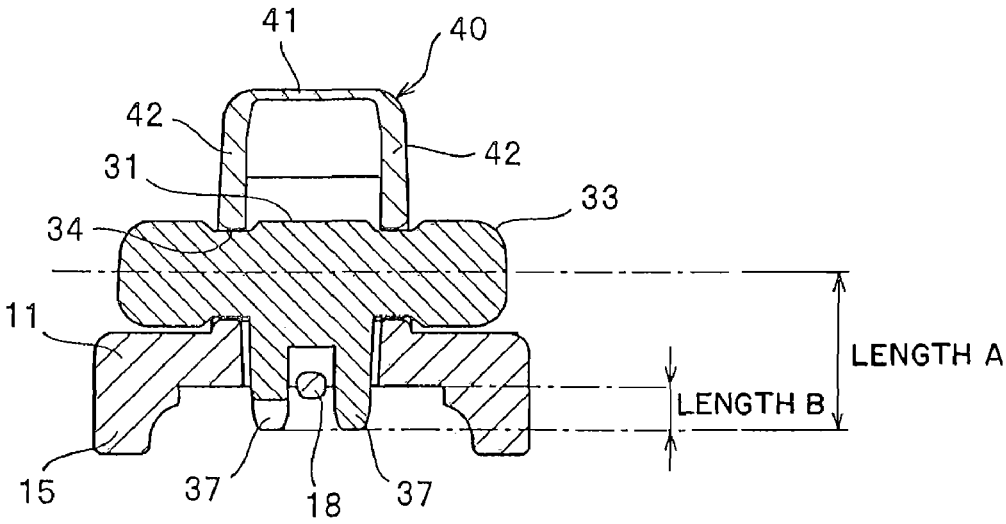
FIG. 5 is a sectional view taken along a line V-V shown in FIG. 4.

FIGS. 1 to 5 show a slide fastener of a first embodiment of the present invention. FIG. 1 is a front view of the slide fastener. FIG. 2 is an exploded perspective view showing a slider provided on the slide fastener in a disassembled state and FIG. 3 is an enlarged perspective view showing a tab and a locking pawl of the slider in enlargement. Further, FIG. 4 is a longitudinal sectional view of the slider and FIG. 5 is a sectional view taken along a line V-V shown in FIG. 4.

As shown in FIG. 1, a slide fastener 1 of a first embodiment includes a pair of right and left fastener stringers 2 and a slider 9.

The fastener stringer 2 includes a pair of right and left fastener tapes 3 and a coil-like element 5 which forms right and left element rows 4 attached to opposite tape side edge portions of the fastener tape 3. In this case, the coil-like element 5 is formed of monofilament of synthetic resin such as polyamide and polyester, and as shown in FIG. 5, for example, the elements are sewed to the side edge portion of the fastener tape 3 by double chain stitch of sewing yarn 7 with a core thread 6 inserted through the inside of the elements. In the meantime, according to the first embodiment, a chain width of the slide fastener 1 is set to about 6 mm.

As shown in FIG. 2, the slider 9 includes three components, a slider body 10, a tab 30 attached to the slider body 10 rotatably and a cover body 403 for attaching the tab 30 to the slider body 10. The tab 30 contains a locking pawl 31 formed integrally therewith in order to lock the slider 9. These three components 10, 30, 40 are formed into a predetermined shape by means of injection molding means or extrusion molding means using thermoplastic resin such as polyamide, polyacetal, polypropylene, polybutylene terephthalate.

In the slider body 10, an upper blade 11 and a lower blade 12 are connected at a front portion of the slider body by a diamond 13, and a Y-shaped element guide passage 14 which communicates right and left shoulder mouths provided at the front portion with a rear mouth provided at the rear end is formed between the upper blade 11 and the lower blade 12 disposed substantially in parallel. Upper flanges 15 are provided on right and left side edges on a rear portion side of the upper blade 11 in a direction perpendicular to the upper blade 11 such the upper flanges are drooped toward the lower blade 12.

An accommodating portion 17 for accommodating the locking pawl 31 is formed substantially in a central portion of the upper blade 11 of the slider body 10, and a partitioning 18 stretched in the back and forth direction and right and left window portions 19 bored in both right and left sides of the partitioning 18 up to the element guide passage 14 are disposed on a bottom portion of the accommodating portion 17. Supporting wall portions 21 are erected on both right and left sides of the accommodating portion 17, and concave bearing portions 22 for bearing a rotation shaft portion 34 of the tab 30 are formed in the central portion of the supporting wall portions 21. Further, engaging columns 23 including an engaging portion 23*a* to which the cover body 40 is to be attached are disposed between the right and left supporting wall portions 21 in front of and in the back of the accommodating portion 17.

The tab 30 includes a tab main body 32 which serves as a gripping portion, arm portions 33 extended from the tab main body 32 and the rotation shaft portion 34 disposed between front ends of the arm portions 33. The locking pawl 34 is formed integrally at the central portion in a width direction of the rotation shaft portion 34. The locking pawl 31 is extended from the rotation shaft portion 34 in a direction perpendicular to the upper blade 11 with respect to the longitudinal direction of the tab and includes a pawl proximal portion 36 connected to the rotation shaft portion 34 and first pawl portion 37 on the left side and second pawl portion 38 on the right side projecting from the front end of the pawl proximal portion 36 (see FIG. 3).

As shown in FIG. 4, the pawl proximal portion 36 is formed such that the pawl proximal portion embraces the rotation shaft portion 34 when seen in its sectional view while expanding toward the upper blade 11. A concave groove 39 in which the partitioning 18 of the slider body 10 is to be fitted is formed in the central portion in the width direction at a front end face of the pawl proximal portion 36. The first and second pawl portions 37, 38 are provided on the right and left sides across the concave groove 39 such that the first and second pawl portions are extended from the front end of the pawl proximal portion 36 in a rectangular solid.

The positions of the first pawl portion 37 and the second pawl portion 38 are deflected by an amount corresponding to a gap between adjoining elements 5 of the fastener stringer 2 in the longitudinal direction of the tab 30, so that the first pawl portion 37 on the left side is disposed forward while the second pawl portion 38 on the right side is disposed backward. The first and second pawl portion 37, 38 have a first contact surface (front face) which faces the shoulder mouth side of the slider body 10 and a second contact surface (rear face) which faces the rear mouth side when the locking pawl 31 is projected into the element guide passage 14.

In this case, when the tab 30 is rotated by its own weight after the sliding operation of the slider 9 is ended, the first contact surface of the first pawl portion 37 comes into contact with the first element 5*a* of the element row 4 so as to stop the rotation of the tab 30 temporarily. After the slider 9 starts to move forcibly in a direction of separating the elements from a state in which the rotation of the tab 30 is stopped, as described later, the second contact surface comes into contact with the second element 5*b* so as to stop the forced movement of the slider 9.

The cover body 40 has a cover portion 41 in which a front wall, a top wall and a rear wall are formed consecutively, side walls 42 drooped from the right and left side edges of the top wall of the cover portion 41, bearing portions 43 provided concavely in a central portion of a bottom end of the side walls 42 and an engaged portion 44 projected inward from the inner face of the front wall and rear wall of the cover portion 41.

When the slider 9 is assembled using three components, the slider body 10, the tab 30 and the cover body 40 described above, first, the locking pawl 31 is accommodated in the accommodating portion 17 of the slider body 10. With this configuration, the rotation shaft portion 34 of the tab 30 is placed on the bearing portion 22 of the slider body 10, and the tab 30 is held such that the tab main body 32 is substantially in parallel to the top face (external face) of the upper blade 11.

Next, the cover body 40 is mounted from above the slider body 10 so that it is fitted and attached to the right and left supporting wall portions 21 and further, the cover body 40 is pressed downward so as to engage the engaged portions 44 of the cover body 40 to the engaging portion 23*a* provided on the engaging column 23 of the slider body 10. Consequently, the rotation shaft portions 34 of the tab 30 are fitted into between the bearing portion 22 of the slider body 10 and the bearing portion 22 of the cover body 40, so as to obtain the slider 9 in which the tab 30 is attached to the top face side of the upper blade 11 rotatably around the rotation shaft portions 34.

In the slider 9 assembled in the above-described way, when the tab 30 is tilted to the rear mouth side of the slider body 10 until the tab becomes substantially parallel to the top face of the upper blade 11 as shown in FIG. 4, a part of the locking pawl 31 is projected into the element guide passage 14 of the slider body 10. When the tab 30 is rotated to the shoulder mouth side of the slider body 10 from the state in which a part of the locking pawl 31 is projected out, the projected locking pawl 31 is retracted from the element guide passage 14.

In this case, in the slider 9 of the first embodiment, an angle θ between the upper blade 11 and the tab 30, when the locking pawl 31 is retracted from the element guide passage 14, is set to 30° or more and 50° or less.

Figure 6:
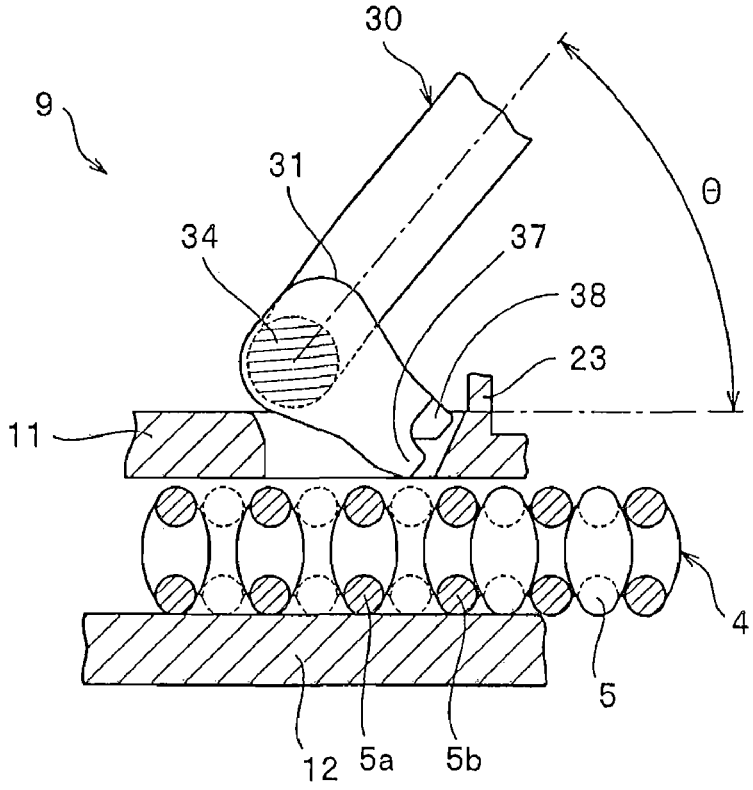
FIG. 6 is a partial sectional view schematically showing sections of an element row and a slider when a sliding operation of the slider is made.

Usually, when the slider 9 is slid in an element separating direction or in a closing direction, a tilting angle of the tab 30 with respect to the top face on the rear mouth side of the upper blade 11 is kept at 50° or more. Thus, if the angle θ when the locking pawl 31 is retracted from the element guide passage 14 is set to 50° or less as shown in FIG. 6, the sliding operation of the slider 9 can be carried out smoothly without locking pawl 31's being hooked by the element row 4 when the slider 9 is slid.

The angle θ when the locking pawl 31 may be retracted from the element guide passage 14 is set to larger than 30°. In this case, when the tab 30 is tilted completely to the rear mouth side of the slider body 10, a projection length of the locking pawl 31 projecting into the element guide passage 14 (that is, a length B from the inner face of the upper blade 11 of the slider 9 up to the front end of the pawl portion of the locking pawl 31 (see FIG. 5)) can be secured to an appropriate length.

For example, the aforementioned angle θ when the locking pawl 31 may be retracted from the element guide passage 14 is set to less than 30°. In this case, when the tab 30 is tilted completely to the rear mouth side of the upper blade 11 from the state in which the locking pawl 31 is retracted from the element guide passage 14, the angle by which the tab 30 is rotated is less than 30° because the tab 30 can be rotated up to an angle at which the tab becomes substantially parallel to the top face of the upper blade 11.

In this case, the ratio of the length B with respect to the length A from the center of the axis of the rotation shaft portion 34 of the tab 30 up to the front end of the pawl portion of the locking pawl 31 is decreased. Thus, to secure the projecting length of the locking pawl 31 projecting into the element guide passage 14 appropriately when the tab 30 is tilted completely to the rear mouth side of the upper blade 11, the length A needs to be increased by forming the locking pawl 31 in a large size, thereby inducing an enlargement of the slider 9.

In other words, by setting the angle θ to larger than 30°, the ratio of the length B with respect to the length A from the center of the axis of the rotation shaft portion 34 of the tab 30 up to the front end of the pawl portion of the locking pawl 31 is increased. Thus, the projecting length of the locking pawl 31 projecting into the element guide passage 14 (the length B) can be secured appropriately without increasing a size of the locking pawl 31 itself. For the reason, when the slider 9 is moved forcibly in an element separating direction from the state in which the rotation of the tab 30 is locked as described later, the slider 9 can be locked stably by fitting the locking pawl 31 into between adjoining elements 5 of the element row 4.

Particularly, in the slider 9 of the first embodiment, in order to set the angle θ between the upper blade 11 and the tab 30, when the locking pawl 31 is retracted from the element guide passage 14, to 30° or more and 50° or less, a ratio between the length A from the center of the axis of the rotation shaft portion 34 of the tab 30 and the length B form the inner face of the upper blade 11 of the slider 9 up to the front end of the pawl portion of the locking pawl 31 when the slider 9 is locked is set to 0.14 or more and 0.35 or less. In the meantime, the value of this ratio B/A is introduced from the angle θ between the upper blade 11 and the tab 30 when the locking pawl 31 is retracted from the element guide passage 14 using trigonometrical function.

In this case, in the slider 9 of the first embodiment, a chain width of a slider fastener 1 is 6 mm, the length B from the inner face of the upper blade 11 of the slider 9 up to the front end of the pawl portion of the locking pawl 31 is preferred to be set to 0.5 mm or more and 1.0 mm or less, particularly 0.6 mm or more and 0.8 mm or less. In the meantime, if the length B is set to 0.5 mm, the length A is set to 1.43 mm or more and 3.57 mm or less based on the range of the ratio B/A, and if the length B is set to 1.0 mm, the length A is set to 2.86 mm or more and 7.14 mm or less.

The slide fastener 1 of the first embodiment in which the above-described slider 9 is inserted through the element row 4 is attached to mainly a fly or the like of clothes along a vertical direction such that the shoulder mouth side of the slider 9 is directed upward while the rear mouth side is directed downward. In this case, by keeping the tab 30 at an angel of 50° or more with respect to the top face on the rear mouth side of the upper blade 11 and sliding the slider 9 in the element separating direction or closing direction, right and left fastener stringers 2 can be separated or closed smoothly without locking pawl 31's being hooked by the element row 4.

In the slide fastener 1 attached to the fly or the like of clothes, when a user slides the slider 9 in the element separating direction or element closing direction, the user grips the tab 30 with the fingers and slides the slider 9 with the tab 30 tilted naturally at an angle of 50° or more with respect to the top face on the rear mouth side. For the reason, the slide fastener 1 of the first embodiment allows the user to operate the slider 9 smoothly without making him or her conscious of picking up the tab 30 higher than required.

Figure 7:
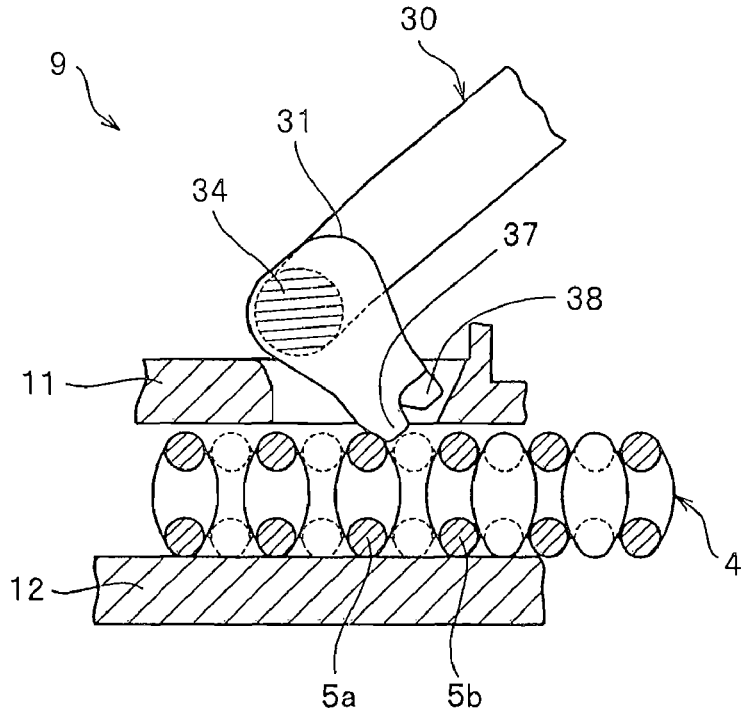
FIG. 7 is a partial sectional view schematically showing the sections of the element row and the slider when the tab is held temporarily.

When a user ends the operation of the slider 9 after sliding the slider up to a desired position, the user releases the tab 30 so that the tab 30 is rotated to the rear mouth side of the slider 9 by its own weight. Consequently, in the tab 30, the locking pawl 31 is projected into the element guide passage 14 through the window portion 19 formed in the upper blade 11, so that as shown in FIG. 7, the first contact surface of the first pawl portion 37 disposed on the locking pawl 31 is brought into contact with one of the elements 5 of the fastener stringer 2. As a result, the tab 30 is held in a rotation locked state such that the tab is tilted at a predetermined angle with respect to the top face on the rear mouth side of the upper blade 11. An element with which the first pawl portion 37 makes contact in this state is referred to as a first element 5*a*.

The tab 30 is held in the rotation stopped state when the operation of the slider 9 is ended, so that it is recognized visually that the locking pawl 31 has not locked the slider 9. Further, when the sliding operation of the slider 9 is restarted, a user can grip the tab 30 easily and operate the slider 9 easily. In the first embodiment, the first contact surface of the first pawl portion 37 is formed such that it is tilted slightly backward with respect to the front face of the pawl proximal portion 36 so that the first pawl portion 37 can make an appropriate contact with the first element 5*a* when the tab 30 is held in the rotation stopped state.

Figure 8:
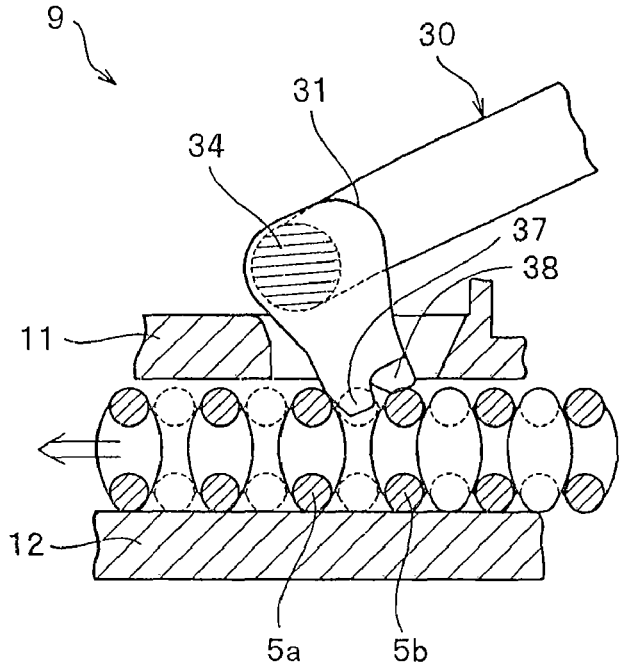
FIG. 8 is a partial sectional view schematically showing the sections of the element row and the slider when the slider is moved forcibly from the state in which the tab is held temporarily.

When the tab 30 is held in the above-described rotation stopped state, for example, if the right and left fastener stringer 2 receives a lateral pulling force and is opened from a state indicated with a phantom line to that indicated with a solid line shown in FIG. 1, the slider 9 is moved forcibly in the element separating direction (a rear mouth direction of the slider 9). In this case, the slider 9 is moved forcibly from the rotation stopped state of the tab 30, so that as shown in FIG. 8, the tab 30 is rotated by its own weight with the first contact surface of the first pawl portion 37 kept in contact with the first element 5*a*. Consequently, the first pawl portion 37 is fitted into between the first element 5*a* of the element row 4 on the left side, and a second element 5*b* adjoining in a rear side direction, and the second pawl portion 38 of the locking pawl 31 is also fitted into between the elements 5 of the element row 4 on the right side.

At this time, in the first embodiment, a gap between the first contact surface and the second contact surface of the first and the second pawl portions 37, 38 of the locking pawl 31 is set smaller than a gap between the elements 5 of the fastener stringer 2. Consequently, when the tab 30 is rotated by its own weight, the first and second pawl portions 37, 38 of the locking pawl 31 can be fitted into between the elements 5 of the right and left element rows 4 easily.

Further, when the slider 9 is moved forcibly with the first and second pawl portions 37, 38 being fitted in between the elements 5 of the right and left element rows 4, the right and left elements 5 are moved relatively forward of the slider 9 with respect to the slider body 10. As a result, the second contact surface of the first pawl portion 37 comes into contact with the second element 5*b* of the element row 4 on the left side, while the second contact surface of the second pawl portion 38 comes into contact with the element 5 of the element row 4 on the right side.

Figure 9:
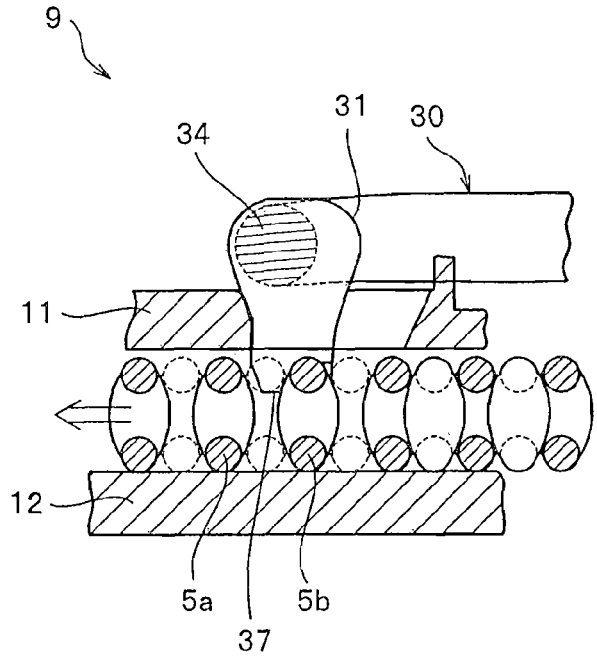
FIG. 9 is a partial sectional view schematically showing the sections of the element row and the slider when the slider is locked.
Figure 10:
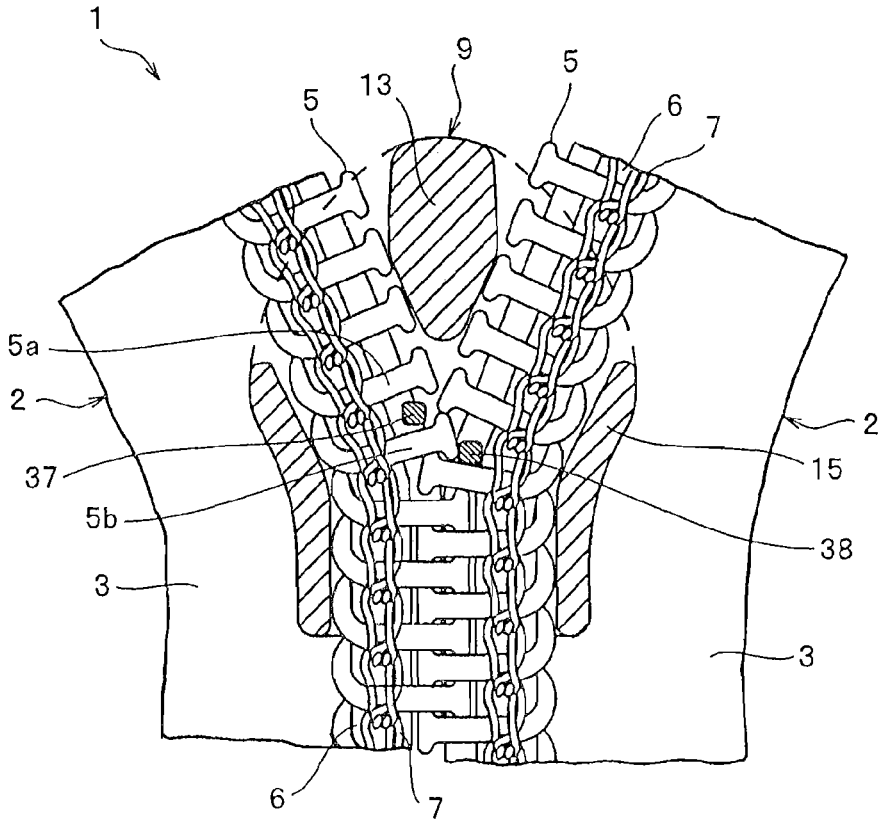
FIG. 10 is an explanatory view for explaining the states of the element row and the slider when the slider is locked.

After that, when the slider 9 is moved forcibly with the second contact surface of the first and second pawl portions 37, 38 kept in contact with the element 5, as shown in FIG. 9 and FIG. 10, the front face of the pawl proximal portion 36 of the locking pawl 31 comes into contact with the front wall face of the window portion 19 in the upper blade 11 so that a rotation of the tab 30 is stopped at that rotation limit. That is, because the rotation of the tab 30 is stopped when the front face of the pawl proximal portion 36 comes into contact with the front wall face of the window portion 19, the first and second pawl portions 37, 38 fitted in between the elements 5 maintain a contact with the elements 5 to stop the forced movement of the slider 9, thereby locking the slider stably. In the meantime, FIG. 10 represents the slider 9 with its sectional view to facilitate understanding of the positions of the first and second pawl portions 37, 38 when the slider 9 is locked.

In the present invention, a means for stopping the rotation of the tab at the rotation limit is not restricted to bringing the front face of the pawl proximal portion of the locking pawl into contact with the front wall face of the window portion of the upper blade, but other means may be used. For example, by erecting a tab supporting post on the top face on the rear mouth side of the upper blade, it is permissible to bring the tab into contact with the supporting post to stop the rotation of the tab at the rotation limit.

As described above, in the slide fastener 1 of the first embodiment, the locking pawl 31 and the first/second pawl portions 37, 38 can be fitted into between the elements 5 by using rotation of the tab 30 by its own weight and the forced movement of the slider 9 in the element separating direction. Thus, in the slide fastener 1, the slider 9 can be automatically locked stably without use of any metallic resilient member such as a leaf spring.

Therefore, in the slide fastener 1 of the first embodiment, the slider 9 can be constructed using only components formed of the same synthetic resin, so that the material of the slider 9 is recycled easily. Further, because the slide fastener 1 of the first embodiment uses no cam for pressing the locking pawl 31 as mentioned in Japanese Patent Laid-Open Publication No. 2000-333710, the locking pawl 31 can be prevented from being worn even if locking of the slider 9 is repeated, thereby maintaining the locking function of the slider 9 stably in a long period.

Figure 11:
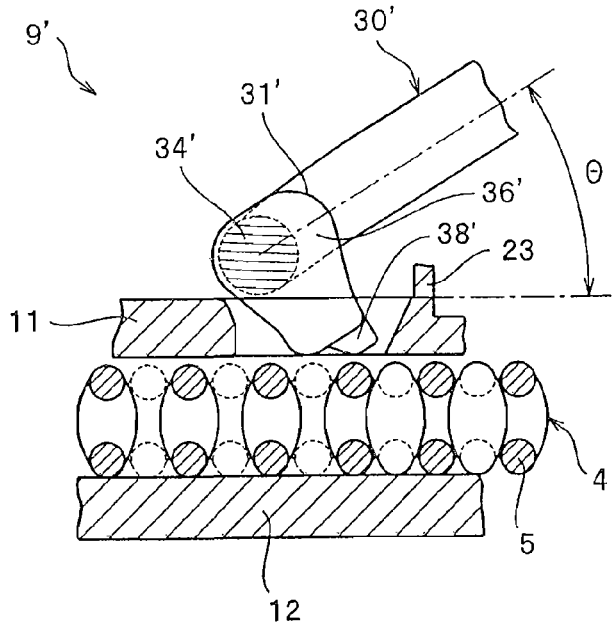
FIG. 11 is a partial sectional view showing a part of the slider according to a modification of the first embodiment.

Although, in the slide fastener 1 of the first embodiment, the first pawl portion 37 on the left side and the second pawl portion 38 on the right side are disposed on the locking pawl 31 of the slider, a requirement of the present invention is that at least any one of the right and left pawl portion is disposed to constitute the locking pawl, and the slide fastener may be constituted using a slider 9' which is a modification of the first embodiment excluding the first pawl portion 37 from the locking pawl 31 of the first embodiment as shown in FIG. 11, for example.

That is, in the slider 9' shown in FIG. 11, a pawl proximal portion 36' of a locking pawl 31' is connected with a rotation shaft portion 34' of a tab 30' integrally, and a pawl portion 37' (corresponding to the second pawl portion of the first embodiment) is extended from the front end of the pawl proximal portion 36'. The pawl portion 38' is disposed on the right side of a concave groove formed in the pawl proximal portion 36'.

In case of such a slider 9', when the slider 9' is moved forcibly in the element separating direction from a state in which the rotation of the tab 30' is stopped like the slider 9 of the first embodiment, the pawl portion 38' of the locking pawl 31' can be fitted into between the elements by using the rotation of the tab 30' by its own weight and the forced movement of the slider 9. Thus, the slider 9' can be automatically locked without use of any resilient member such a leaf spring. Therefore, the slide fastener having the slider 9' in FIG. 11 can obtain the same effect as the first embodiment.

Second Embodiment

Figure 12:
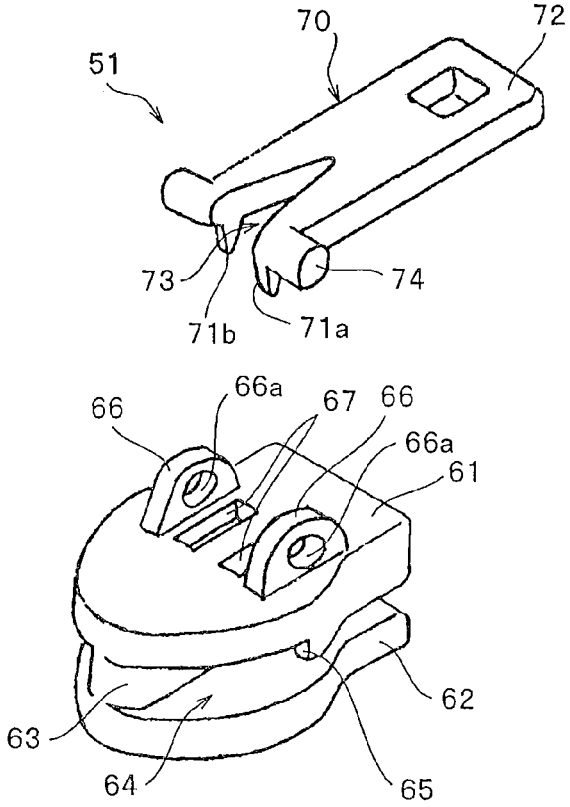
FIG. 12 is an exploded perspective view showing a slider provided on a slide fastener according to a second embodiment of the present invention in a disassembled state.
Figure 13:
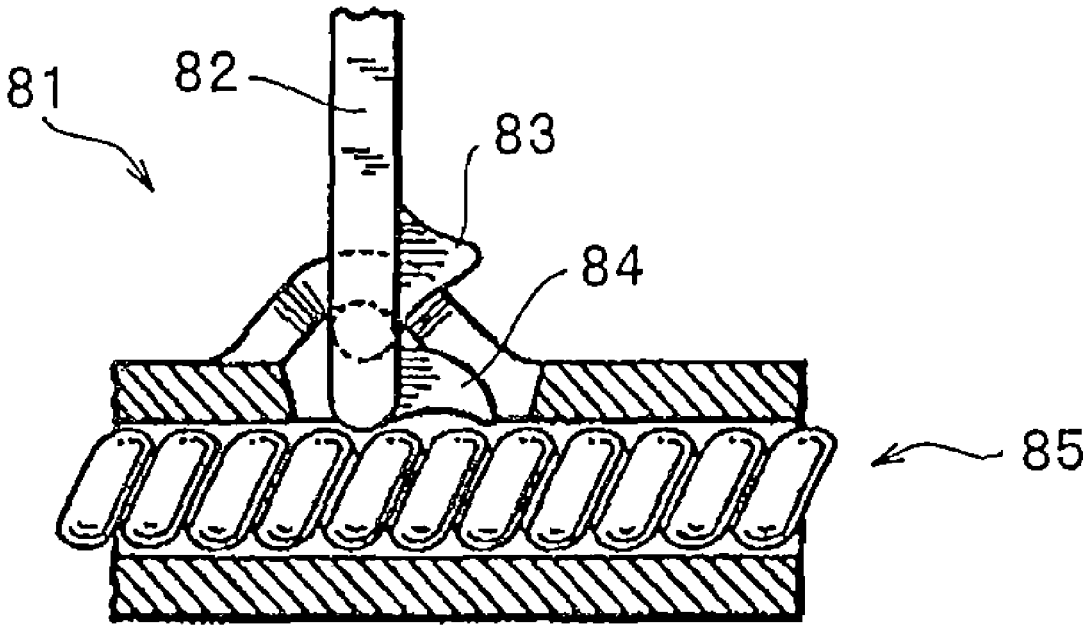
FIG. 13 PRIOR ART
FIG. 13 is a partial sectional view showing a part of a slider of the prior art.

FIG. 12 is an exploded perspective view showing a slider for use in a slide fastener according to a second embodiment of the present invention in a disassembled state.

The slide fastener of the second embodiment is provided with a pair of right and left fastener stringers (not shown) and a slider 51. As a fastener stringer in the second embodiment, the same fastener stringer as the first embodiment is used.

The slider 51 of the second embodiment is comprised of two components, a slider body 60 and a tab 70 which is to be attached rotatably to the slider body 60. The tab 70 has right and left locking pawls 71*a*, 71*b* formed integrally to lock the slider 51. These two components 60, 70 are formed into a predetermined shape by means of an injection molding means or extrusion molding means using thermoplastic resin such as polyamide, polyacetal, polypropylene, polybutylene terephthalate.

In the slider body 60, an upper blade 61 and a lower blade 62 are connected at a front portion thereof by a diamond 63, and a Y-shaped element guide passage 64 for communicating right and left shoulder mouths provided on a front portion with a rear mouth provided at a rear end is formed between the upper and lower blades 61, 62 disposed substantially in parallel. Upper flanges 65 are drooped toward the lower blade 62 from right and left side edges on the rear portion side of the upper blade 61. Tab attaching posts 66 each having a hole portion 66*a* are erected substantially in the center in the back and forth direction of the slider body 60 on the upper blade 61 such that the tab attaching posts are departed from each other in the width direction of the slider. Right and left window portions 67 which penetrate the upper blade 61 are bored in parallel inside of the right and left tab attaching posts 66.

The tab 70 includes a tab main body 72 which serves as a gripping portion, a rotation shaft portion 74 disposed at an end of the tab main body 72 and right and left locking pawls 71*a*, 71*b* formed integrally on the rotation shaft portion 74 such that the right and left locking pawls are extended in a direction perpendicular to the upper blade 61 side with respect to the longitudinal direction of the tab. A substantially rectangular cutout portion 73 which is open to the rotation shaft portion 74 side is formed in an end portion of the tab 70. Further, the right and left locking pawls 71*a*, 71*b* present an inverted triangular shape as seen from sideways, and a pawl proximal portion connected to the rotation shaft portion 74 of the tab 70 and a pawl portion which is projected from the front end of the pawl proximal portion while the pawl portion can be fitted into between elements of an element row are formed continuously.

When the slider 51 is assembled using two components, the slider body 60 and the tab 70, first a user grips the tab 70 on both the right and left sides, presses the rotation shaft portion 74 side of the tab main body 72 from both the right and left sides and maintains it with a gap of the cutout portion 73 kept smaller. Next, the user inserts the rotation shaft portion 74 of the tab 70 in between the right and left tab attaching posts 66 of the slider body 60. After that, by releasing the pressing state of the tab main body 72, the rotation shaft portion 74 is fitted into the hole portions 66*a* in the tab attaching post 66.

To prevent the locking pawls 71*a*, 71*b* formed integrally with the tab 70 from interfering with the upper blade 61 of the slider body 60, the rotation shaft portion 74 of the tab 70 is preferred to be fitted into the hole portion 66*a* in the tab attaching post 66 with the tab 70 tilted by for example 90° to 180° with respect to the top face on the rear mouth side. By the above-described operation, the tab 70 is attached rotatably around the rotation shaft portion 74 so as to assemble the slider 51.

In the slider 51 assembled in this way, when the tab 70 is tilted to the rear mouth side of the slider body 60 until the tab becomes substantially parallel to the top face of the upper blade 61, part of the right and left locking pawls 71*a*, 71*b* is projected into the element guide passage 64 of the slider body 60. When the tab 70 is rotated from a state in which a part of the locking pawls 71*a*, 71*b* is projected to the shoulder mouth side of the slider body 60, the projecting locking pawls 71*a*, 71*b* are retracted from the element guide passage 64.

In the slider 51 of the second embodiment, an angle θ between the upper blade 61 and the tab 70, when the locking pawls 71*a*, 71*b* are retracted completely from the element guide passage 64, is set to 30° or more and 50° or less like the first embodiment. Consequently, when the sliding operation of the slider 51 is carried out, the slider 51 can be slid smoothly without the locking pawls 71*a*, 71*b*'s being hooked by the element rows. At the same time, when the tab 70 is tilted completely to the rear mouth side of the upper blade 61, the projection length (a length B from the inner face of the upper blade 61 of the slider 51 up to the front end of the pawl portion of the locking pawl 71) of the locking pawls 71*a*, 71*b* projecting into the element guide passage 64 can be secured to an appropriate length.

The slide fastener of the second embodiment in which the slider 51 is inserted through the element rows is sewed on mainly a fly of clothes or the like. In this case, in the slider of the second embodiment, when the operation of the slider 51 is ended by sliding the slider 51 up to a desired position, the tab 70 is rotated to the rear mouth side of the slider 51 by its own weight. Consequently, the locking pawls 71*a*, 71*b* of the tab 70 are projected into the element guide passage 64 through the window portion 67 formed in the upper blade 61 so as to bring the front face (first contact surface) of the pawl portion of the locking pawl 71*a* on the left side into contact with elements (first element) of the fastener stringer. As a result, the tab 70 is held in the rotation stopped state in which the tab is tilted at a predetermined angle with respect to the top face on the rear mouth side of the upper blade 61.

After that, if the right and left fastener stringers receive a lateral pulling force so that the slider 51 is moved forcibly in the element separating direction, the tab 70 is rotated by its own weight with the front face of the pawl portion of the locking pawl 71*a* on the left side kept in contact with the first element like the first embodiment. Consequently, the pawl portion of the locking pawl 71*a* on the left side is fitted into between elements of the element row on the left side and at the same time, the pawl portion of the locking pawl 71*b* on the right side is fitted into in between the elements of the element row on the right side.

Further, if the slider 51 is moved forcibly with the pawl portions of the right and left locking pawls 71*a*, 71*b* fitted in between the elements of the right and left element rows, the rear faces (second contact surface) of both the pawl portions come into contact with the second element.

After that, if the slider 51 is moved forcibly with the rear faces of the pawl portions of the right and left locking pawls 71*a*, 71*b* kept in contact with the element, the front face of the stop pawl 71*a* comes into contact with the front wall face of the window portion 67 of the upper blade 61 so as to stop a rotation of the tab 70 at its rotation limit. Consequently, the locking pawls 71*a*, 71*b* fitted in between the elements stop a forced movement of the slider 51 and lock the slider 51.

As described above, in the slide fastener of the second embodiment also, the pawl portions of the locking pawls 71*a*, 71*b* are fitted into between the elements by using the rotation of the tab 70 by its own weight and the forced movement of the slider 51 in the element separating direction. As a result, the slider 51 can be automatically locked without use of any resilient member such as a leaf spring like the slide fastener 1 of the first embodiment. Additionally, the locking pawls 71*a*, 71*b* can be prevented from being worn out even if locking of the slider 51 is repeated so as to maintain the locking function of the slider 51 stably in a long period.

Particularly, the slide fastener of the second embodiment is provided with no cover body 40 unlike the slider 9 of the first embodiment, and the slider 51 is constituted of a smaller number of components than the first embodiment. Therefore, cost on the slider 51 can be reduced due to reduction of the quantity of components and at the same time, assembly of the slider 51 can be carried out easily.

In the meantime, the present invention is not restricted to the first embodiment and the second embodiment described above, but may be modified in various ways as long as substantially the same structure as the present invention is possessed and the same operation and effect are exerted.

The element row disposed on the fastener stringer in the slide fastener 1, 51 of the first embodiment and the second embodiment is formed of coil-like continuous element. However, the present invention is not restricted to these examples, but it is permissible to form the element row by attaching zigzag-like continuous elements to the fastener tape instead of the coil-like continuous elements. Alternatively, the element row may be formed by forming independent elements on the fastener tape integrally.

Further, the slide fastener 1 according to the present invention may be attached to for example, a bag as well as the fly of clothes. Although the slider 9 becomes horizontal when the bag is used in a usual state, if the fingers are released from the tab 30 in a state where the tab is tilted slightly to the rear mouth side after the sliding operation by gripping the tab 30 is ended, the tab 30 is rotated by its own weight until the first contact surface of the pawl portions 37, 38 comes into contact with the element 5. Thus, when the slider 51 is moved forcibly, the forced movement is stopped, thereby locking the slider 51.

What is claimed is:

1. A slide fastener with a slider locking mechanism having a pair of right and left fastener stringers in which element rows are attached to opposing tape side edge portions of a pair of fastener tapes and a slider, through which the element rows are inserted, the slider comprising a slider body in which element guide passages are formed between an upper blade having at least one window portion and a lower blade; a tab attached rotatably to a top face side of the upper blade; at least one locking pawl which is formed integrally on the tab and projected into the element guide passages through the at least one window portion in the upper blade to be capable of fitting into between elements constituting the element row, and locking means for stopping a rotation of the tab toward a rear mouth side of the slider at a rotation limit of the tab, the locking pawl having at least one pawl portion to fit into between the elements, wherein a first contact surface configured for contacting a first element of the element rows is formed on a front face of the at least one pawl portion, and a second contact surface configured for contacting a second element of the element rows adjoining the first element in a rear side direction is formed on a rear face of the at least one pawl portion, the rear face being on a side of the at least one pawl portion that is opposite to the first contact surface;

the first contact surface comes into contact with the first element of the element rows so as to temporarily stop a free rotation of the tab under a weight of the tab toward a rear mouth side of the slider;

a second contact surface comes into contact with the second element of the element rows so as to stop a forced movement of the slider when the pawl portion is fitted between the first and second elements, and the locking means is configured to stop the free rotation of the tab at its rotation limit and the forced movement of the slider when the forced movement of the slider occurs while the second element remains in contact with the second contact surface.

2. The slide fastener according to claim 1, wherein the free rotation of the tab restarts so that the second element makes contact with the second contact surface when the slider starts the forced movement in an element separating direction in the rotation stopped state where the first contact surface contacts the first element and the free rotation of the tab is stopped temporarily.

3. The slide fastener according to claim 2, wherein the locking pawl is so configured that, by the slider being moved forcibly from the temporarily-stopped free rotation state of the tab, in which the first contact surface maintains contact with the first element the first contact surface is brought into contact with the first element while the tab restarts the free rotation toward the rear mouth side of the slider and the pawl portion is fitted between the first and second elements by the rotation of the tab, that, by the slider being further moved forcibly in a state where the pawl portion is fitted in between the elements, the second element is brought into contact with the second contact surface of the at least one pawl portion, and that, when the slider is further forcibly moved and the free rotation of the tab toward the rear mouth of the slider is stopped at its rotation limit in a state where the second element maintains contact surface kept in contact with the second contact surface, the forced movement of the slider is stopped.

4. The slide fastener according to claim 2, wherein the tab comprises a rotation shaft portion, the locking pawl is formed integrally with the tab at a central portion in a width direction of the rotation shaft portion, the locking pawl comprises the at least one pawl portion extended in a direction perpendicular to an upper surface of the upper blade with respect to a longitudinal direction of the tab, and the first contact surface of the at least one pawl portion is formed at a rear side position with respect to a front face side of the tab and the longitudinal direction of the tab.

5. The slide fastener according to claim 1, wherein, the second element contacts the second contact surface as the free rotation of the tab restarts when the slider starts the forced movement in an element separating direction in the rotation stopped state where the first contact surface contacts the first element and the free rotation of the tab is stopped temporarily, and when the slider is further moved forcibly and the free rotation of the tab toward the rear mouth side of the slider is stopped at its rotation limit in a state where the second element remains in contact with the second contact surface, the forced movement of the slider is stopped.

6. The slide fastener according to claim 1, wherein the tab comprises a rotation shaft portion, the locking pawl is formed integrally with the tab at a central portion in a width direction of the rotation shaft portion, a pair of right and left supporting wall portions are erected on a top surface of the upper blade, the wall portions including bearing portions on which the rotation shaft portion freely rotates, engaging columns are respectively disposed on front and back portions of the slider body between the right and left supporting wall portions, an accommodating portion for accommodating the locking pawl is formed in a region surrounded by the right and left support wall portions and the respective engaging columns, a cover body is attached to the slider body between the engaging columns, and the rotation shaft portion is rotatably attached between the slider body and the cover.

7. The slide fastener according to claim 1, wherein an angle θ formed between a top face on a rear mouth side of the upper blade and the tab, when the first contact surface of the at least one pawl portion is retracted completely from the element guide passage, is set to be 30° or more and 50° or less.

8. The slide fastener according to claim 7, wherein a ratio B/A where A denotes a length from a center of an axis of a rotation shaft portion of the tab up to a front end of the pawl portion of the locking pawl and B denotes a length from an inner face of the upper blade of the slider up to the front end of the pawl portion of the locking pawl when the forced movement of the slider is stopped, is set to be 0.14 or more and 0.35 or less.

9. The slide fastener according to claim 8, wherein the length B is set to be 0.5 mm or more and 1.0 mm or less.

10. The slide fastener according to claim 1, wherein each of the element rows comprises a coil-like element formed from a monofilament of synthetic resin.

11. The slide fastener according to claim 10, wherein:

the locking pawl comprises a pawl proximal portion connected to the tab, the at least one pawl portion comprises a first pawl portion and a second pawl portion disposed one-by-one projecting from a front end of the pawl proximal portion in right and left directions, respectively, positions of the first pawl portion and the second pawl portion are disposed to be shifted by a gap between adjacent elements in a longitudinal direction of the tab, and the first pawl portion and the second pawl portion are configured to be fitted into right and left element rows, respectively.

12. The slide fastener according to claim 1, wherein:

the tab comprises a tab main body that serves as a gripping portion of the tab, arm portions extending from the tab main body and rotation shaft disposed between front ends of the arm portions, the locking pawl is integrally formed with the tab at a central portion in a width direction of the rotation shaft portion, the locking pawl comprises a pawl proximal portion connected both to the rotations shaft portion and the at least one pawl portion, the at least one pawl portion projecting from the pawl proximal portion, and the first contact surface of the pawl portion is positioned on a rear side with reference to a front face of the pawl proximal portion.

* * * * *